United States Patent [19]

Abolins

[11] Patent Number: 4,871,007

[45] Date of Patent: Oct. 3, 1989

[54] OVERHEAD DOOR CONSTRUCTION FOR PROVIDING INCREASED DOOR OPENING CLEARANCE

[75] Inventor: Andrew Abolins, Langhorne, Pa.

[73] Assignee: Strick Corporation, Langhorne, Pa.

[21] Appl. No.: 245,893

[22] Filed: Sep. 19, 1988

[51] Int. Cl.[4] ..... E05D 15/20

[52] U.S. Cl. ..... 160/201; 160/193; 160/191

[58] Field of Search ..... 160/201, 206, 207, 213, 160/191, 192, 193

[56] References Cited

U.S. PATENT DOCUMENTS

| | | | |
|---|---|---|---|
| 1,908,165 | 5/1933 | Moler | 16/94 R |
| 2,291,583 | 7/1942 | Rowe | 160/201 X |
| 2,694,214 | 11/1954 | Hammer | 160/191 X |
| 2,703,247 | 3/1955 | Wolf et al. | 160/201 X |
| 2,708,478 | 5/1955 | Wolf et al. | 160/191 X |
| 2,786,712 | 3/1957 | Whiting | 160/201 X |
| 3,160,200 | 12/1964 | McKee et al. | 160/201 X |
| 3,412,780 | 11/1968 | Moler | 160/201 X |
| 3,426,829 | 2/1969 | McDaniel et al. | 160/201 |

*Primary Examiner*—Ramon S. Britts
*Assistant Examiner*—David M. Purol
*Attorney, Agent, or Firm*—Kenyon & Kenyon

[57] ABSTRACT

A overhead door assembly which includes a device to maintain the door in a raised position in the door opened position. The door is maintained in a position significantly higher than the position the door would normally assume thus providing an enlarged door opening. The door can be maintained in the raised position by either locating the point of attachment between the load balancing operator cable and the door or by blocking the path of the door in the door guide tracks. Various structures for relocating the cable attachment point and blocking the path of the door are contemplated.

18 Claims, 6 Drawing Sheets

134a
134b
134a
134b
136
130

130a

136

41
232
222
231
230
229

231
222
232
230
229

15a
41
12
39
22
132
129
130

OVERHEAD DOOR CONSTRUCTION FOR PROVIDING INCREASED DOOR OPENING CLEARANCE

BACKGROUND OF THE INVENTION

The present invention is directed to overhead or roll-up doors of the type which are commonly employed in highway trailers, garages, warehouses and the like for displaceably closing a door opening. Such doors typically include a plurality of horizontally hinged panels or boards. The doors are equipped with rollers on opposed sides thereof. The rollers are guided along an inverted "L" shaped path in a pair of inverted "L" shaped guide tracks which are disposed at opposite sides of the door opening.

The multi-panel hinged construction permits the door to articulate or flex when guided by the curved elbow portions of the inverted "L" shaped tracks as it passes through the transition zone between the vertically and horizontally extending tracks. By virtue of their hinged construction and rolling support within the inverted "L" shaped tracks, the overhead or roll-up doors are articulable between a closed position in which the door is held in position by the vertical portions of the tracks with its bottom edge resting on the trailer floor and a open position in which the door is substantially supported by the horizontal portions of the inverted "L" shaped tracks to expose the door opening.

Overhead or roll-up doors of the aforementioned type typically include some form of weight balancing mechanical aid or operator to assist in lifting the door from the closed position to the open position. The need for such a mechanical aid is obvious when one considers the force required to lift the door from the closed to the open position without a mechanical aid. Specifically, the initial vertical upward force required to lift or open the door without any mechanical aid would approximate the weight of the entire door assembly since the rollers are supported in the vertical portion of the track which offers no horizontal support of the rollers and thereby offers no support of the weight of the door panels attached to the rollers. Frequently, the force required to initiate upward movement of the door cannot be achieved by a single person. However, as the door is lifted and more and more door panels enter the horizontal portions of the tracks such that their weight is supported by the tracks, the force required to continue lifting decreases gradually. Finally, in the fully open position, nearly the entire door assembly rests upon the horizontal track portion and the weight of the door is substantially supported by the tracks alone. Thus, left unaided, the force necessary to open and close the door is completely unbalanced. Accordingly, a disadvantageously large force is required to initiate Opening of the door. Additionally, when the door is moved from the open position to the closed position, it tends to slam shut with great force.

For these reasons a balancing device or operator is employed to balance the forces and thereby reduce the physical effort required to open the overhead or roll-up door. The operator also prevents the door from slamming shut with great force when accidentally released during opening or closing and further retains the overhead o roll-up door positively in the open position.

The operator is typically a torsion spring driven winch having at least one cable attached to the bottom panel of the overhead or roll-up door. At installation, the operator's torsion spring is pre-wound slightly, so that when the door is opened, i.e., the door panels are supported on the horizontal portion of the inverted "L" shaped track, a sufficient upward cable pull is exerted upon the bottom door panel to keep it and thereby the rest of the door, from rolling down the tracks. As the door is pulled down, the cable rotates the winch drum of the operator thus winding up the spring. The gradually increasing upward pull of the cable (i.e., cable tension), as the spring is wound up more and more, approximates the increasing rate of the downward pull on the cable by the weight of the door, as more and more panels enter the vertical track portions. Through proper adjustment, it is possible to achieve a near equilibrium between these two forces throughout the vertical range of travel of the door. This makes the opening and closing of the overhead or roll-up door as easy as possible.

FIG. 1 illustrates the details of the connection between the cable of the torsion spring driven winch or operator 20 and the bottom panel of the door. As shown in FIG. 1, the cable 22 is attached to the bottom door panel 41 via a cable anchor 29 at the lowest point practicable. The attachment of the cable 22 to the door proximate the lower edge of the bottom door panel 41 has the effect of increasing the torque arm on which the Cable force acts on the bottom door panel so as to lift the bottom edge of the bottom door panel as high as possible. However, as shown in FIG. 1 in the door open position, the very bottom rollers 12 still remain in the curved portion of the tracks, i.e., the transition zone, such that approximately one half of the weight of the bottom panel plus the weight of the heavy doorlock hardware (not shown in FIG. 1) push these rollers down. If not restrained by the upward pull of the cable 22, the entire door would roll down the tracks and slam shut. Heretofore the sagging of the lower edge of the door has been thought to be a necessary consequence of the fact that the torsion spring driven winch must be located directly above the vertical portion of the guide tracks so as to directly act on the attachment point in the lowermost position.

As noted above, in the raised position as shown in FIG. 1, the upward cable pull in the door opened position is obtained by pre-winding the operator spring. However, the ability to increase the pre-winding force to thereby lift the bottom panel higher is extremely limited since such an increase would immediately affect the cable-pull/door-weight equilibrium mentioned above. Consequently, the position of the bottom door panel with the door open shown in FIG. 1 is typical for most of the overhead or roll-up doors of contemporary design and manufacture.

The sagging of the bottom edge of the bottom door panel below the upper edge of the door opening presents a problem which has heretofore not been fully appreciated. Specifically, the sagging of the lower edge of the bottom panel reduces the effective size of the door opening making it necessary to either use a higher header so that the door edge is not exposed or to allow the door edge to remain exposed. The upper edge of the door opening is defined by either the lower edge of the raised door or the lower edge of the header. In either case, the height of the upper edge is determined by the amount of sagging of the door. Since the amount of sagging and hence, the degree of reduction of door opening size is relatively small, the sagging has not been thought to present too great a problem. For instance, with respect to highway trailers, the inside height of the trailer compartment has in the past been regarded as the critical dimension and little interest has been paid to the size of the door opening. However, in recent years, there has been increased interest in the size of the door opening resulting from, among other things, increased use of automatic loading equipment for loading the highway trailers.

The problem of sagging of the bottom panel of the overhead or roll-up door has come into focus only recently as the result of conflicting demands from the trucking industry. Most significantly, the industry desires a reduction in the height of the header (i.e., the distance between the inside height of the trailer and the vertical height of the door opening) to increase height of the door opening (i.e., the distance between the floor of the trailer and the lower edge of the upper horizontal door frame or header. It is in attempting to minimize the height of the header or upper horizontal door frame member that the problem of sagging of the bottom panel of the overhead or roll-up door has been brought into focus.

As shown in FIG. 1, the minimum header height is dictated by the bottom door panel position with the door open. The bottom of the header should be at the level of or, preferably, slightly below the lower edge seal 39 of the bottom door panel to protect the lower edge of the bottom door panel 41 and seal 39 from being hit and damaged during loading of cargo. Thus, for example in a conventional highway trailer having a conventional operator, i.e., torsion spring driven winch, a $8\frac{1}{8}''$ header (shown in phantom in FIG. 1) would meet this requirement. However, a $6\frac{7}{8}''$ header (shown in solid lines in FIG. 1) would not. The industry has recognized that if it would be possible to lift or prevent sagging of the bottom door panel above the level shown in FIG. 1, then a $6\frac{7}{8}''$ header could be used yielding a increase in door opening height of $1\frac{1}{4}''$ inches. An increase of door height of $1\frac{1}{4}''$ yields a relatively great advantage for the industry which would welcome even a one-half inch increase.

As the industry has become aware of the desirability of lifting (i.e., preventing the sagging) of the bottom door panel, the overhead door industry has attacked the problem in two ways. First, some attempts have been made to increase the strength of the torsion spring of the torsion spring driven winch (i.e., operator). However, this destroys the equilibrium as described above. Additionally the industry has found it desirable to anchor the cable of the operator at the lowest point possible along the bottom door panel so as to maximize the torque arm of the operator on the door to lift the bottom panel as high as possible. However, this is only a partial solution since sagging still occurs to an undesirable degree. Thus, there remains a need for reducing the degree of sagging of the bottom door panel of the overhead or roll-up door in the raised position so as to increase the effective door opening height.

While the specific problem addressed by the present invention is discussed above, with respect to the specific problem of highway trailers, it is to be understood that the reduction of sagging of the overhead door also offers similar advantages in overhead or roll-up doors used in garages and warehouses.

SUMMARY OF THE INVENTION

The present inVention is directed to means for preventing sagging of an overhead or roll-up door. Two general methods of maintaining the door in the raised position are contemplated. First, the inventors have recognized that the door can be maintained in a raised position by increasing the lever arm on which the cable pull force acts on the bottom door panel. In accordance with the present invention, this may be accomplished by attaching the cable to the bottom door panel at a point below the lower edge of the bottom door panel through a special cable anchor fitting with a floating cable attachment point. In the door open position, the fitting extends the attachment point well below the bottom edge of the door panel, which considerably increases the lifting force exerted on the lower edge of the door panel without any increase in cable tension. In the door closed position, the fitting component is automatically retracted to a position above the bottom panel edge where it does not interfere with either the closing or sealing of the door.

The second general method of maintaining the overhead or roll-up door in the raised position is by blocking the path of the rollers in the inverted "L" shaped track so that once the door is in the raised position, it cannot be lowered past the desired point. The blocking of the path of the rollers may be done manually, semi-automatically or automatically.

The present invention contemplates a variety of means of implementing the above two methods of maintaining the overhead or roll-up door n the raised position. Illustrative examples of such means are described in detail below.

FIG. *6a* is a perspective view of a second illustrative example of the present invention with the door in the closed position.

FIG. *6b* is a perspective view of the illustrative example of FIG. *6a* with the door in the open position.

Figure 7:
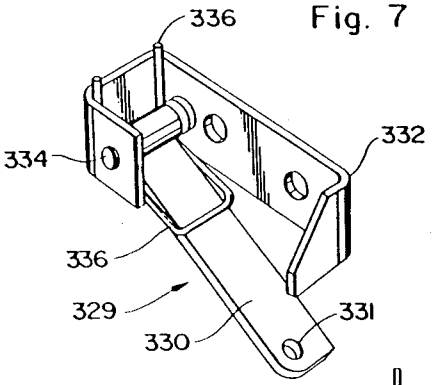

FIG. 7 is a perspective view of a third illustrative example of the present invention.

Figure 8:
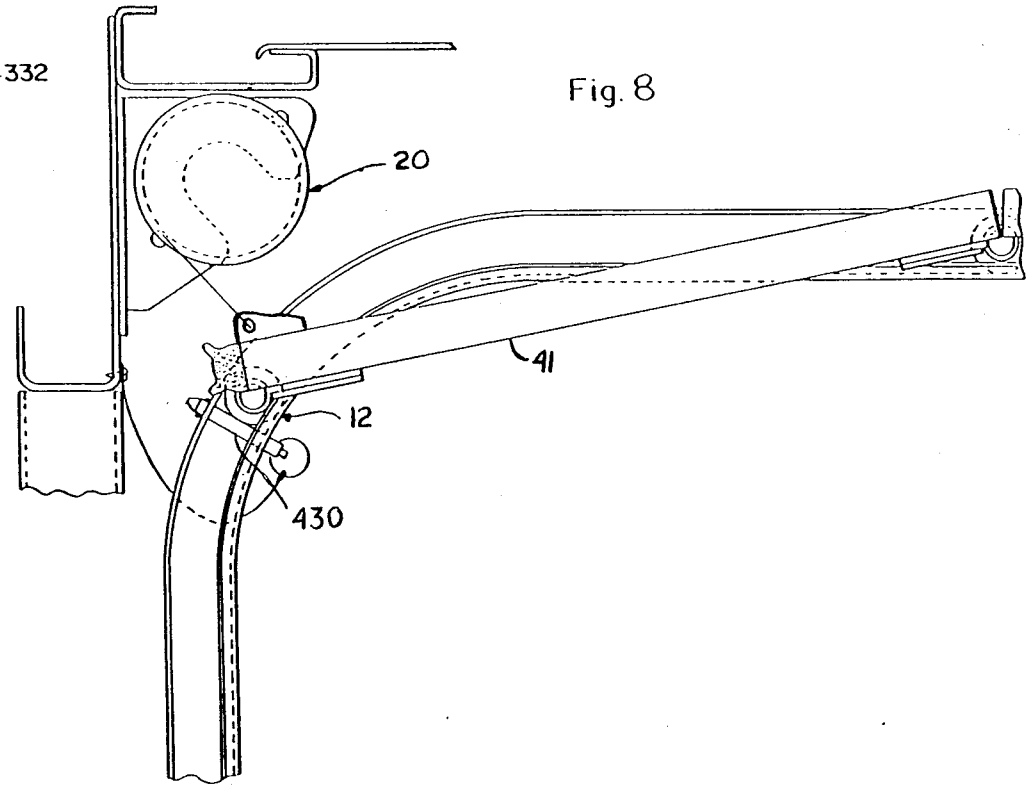

FIG. 8 is a side view of a known arrangement in which the door is maintained in the raised position by a manually inserted blocking pin.

Figure 9:
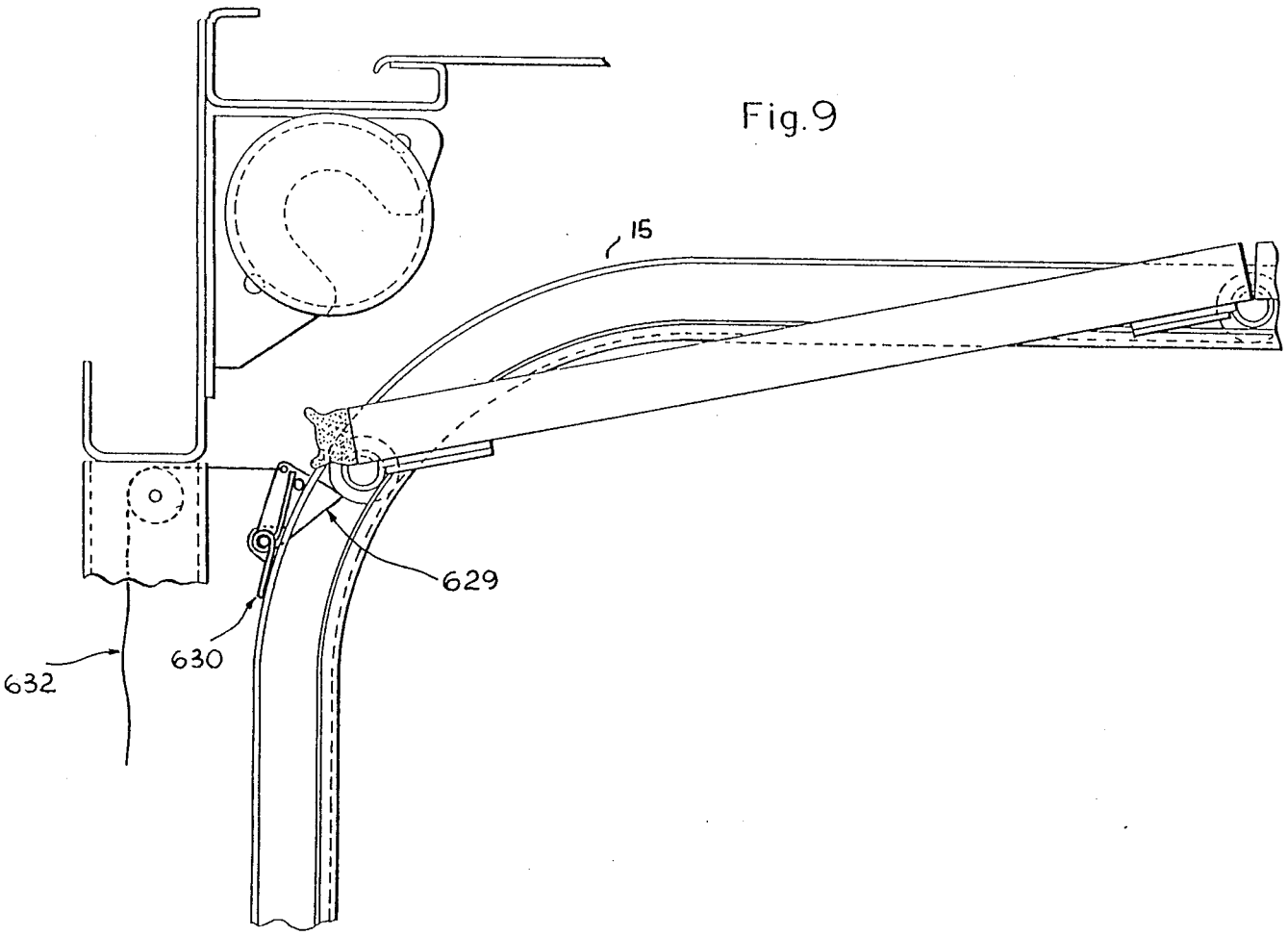

FIG. 9 is an illustrative example of the present invention in which the door is maintained in the raised position by a spring loaded blocking wedge.

DETAILED DESCRIPTION OF THE DRAWINGS

Figure 1:
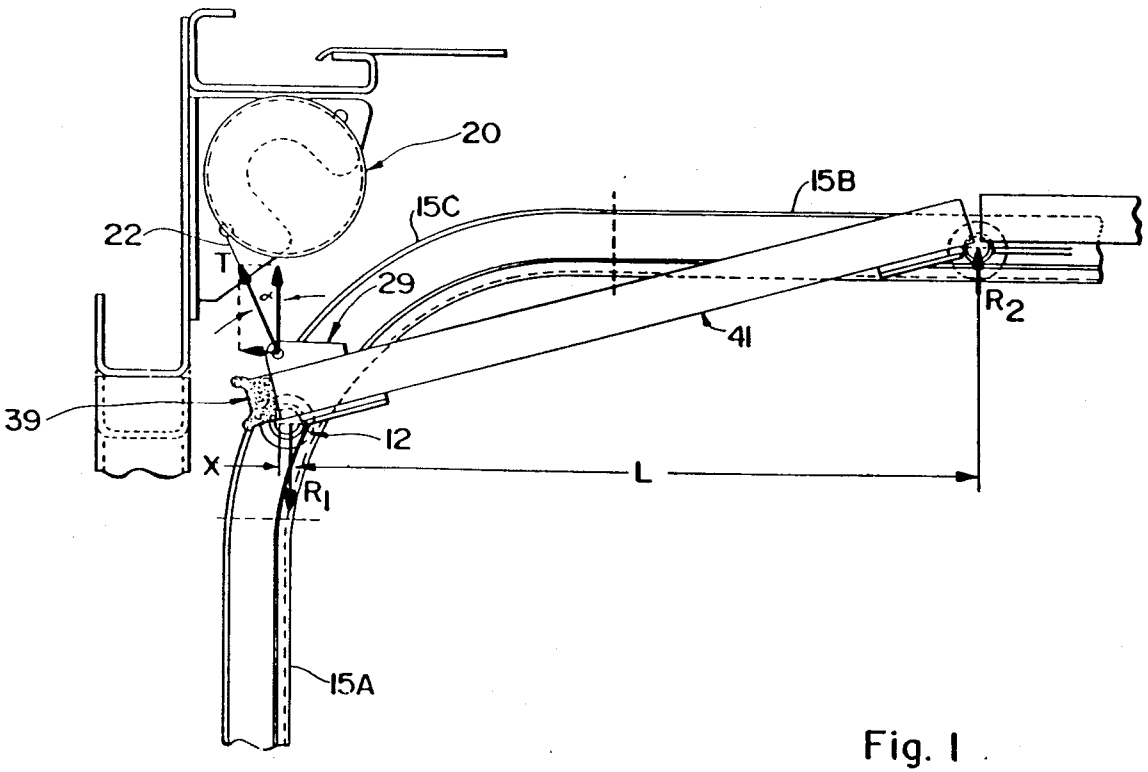
FIG. 1 is a side view of a conventional overhead or roll-up door in which the cable from the operator is connected to the bottom door panel with a conventional cable anchor.

FIG. 1 shows a conventional cable anchor construction in which the overhead door is in the opened position. As discussed above, the cable 22 of the spring driven operator 20 is attached to the bottom door panel 41 via a fixed cable anchor 29. The point of attachment is as close as practicable to the bottom edge of the bottom door panel 41 at which the seal 39 is connected.

The forces applied to the door via the operator 20 are graphically represented in FIG. 1. Specifically, vector T represents the force of cable tension of the cable 22 of the operator 20. This vector has a vertical component T COS $\alpha$ and a horizontal component T SIN $\alpha$, where $\alpha$ is the acute angle between the cable tension vector T and the vertical component of the table tension vector as shown in FIG. 1. As indicated in FIG. 1, the cable tension vector vertical component is balanced by a reaction force R1 applied at the bottom roller 12 and a second reaction force R2 applied at the roller between the bottom door panel and the next to bottom door panel. The door panel edge lifting force is of the same magnitude, but of opposite direction, as the reaction force R1 shown applied at the bottom roller.

Figure 2:
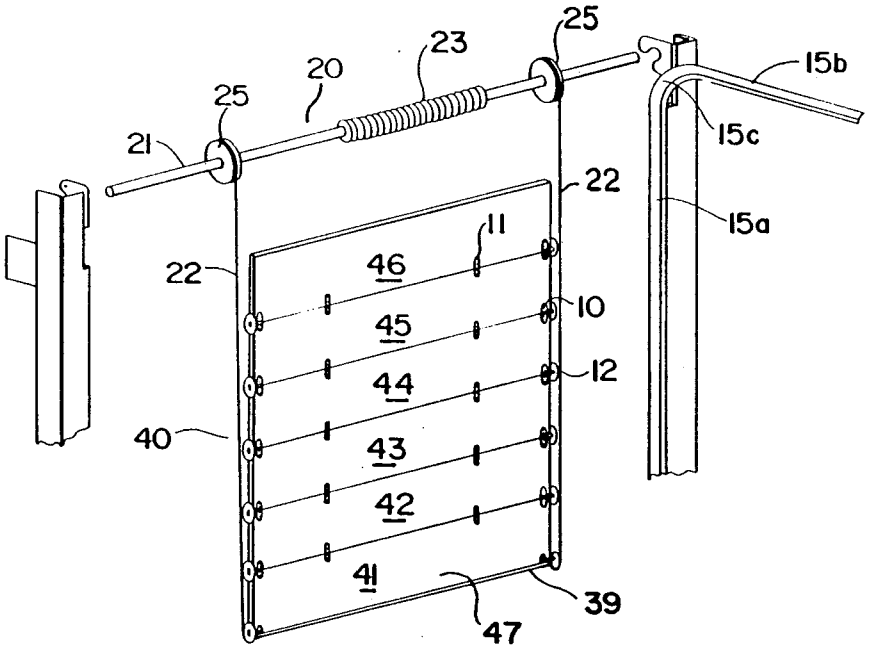
FIG. 2 is an exploded perspective view of a conventional overhead or roll-up door assembly.

FIG. 2 is an exploded perspective view of the significant components of a typical overhead or roll-up door assembly. As shown in FIG. 2, the assembly includes a pair (only one shown) of inverted (L) shaped tracks 15. Each track includes a vertical portion 15*a*, a horizontal portion 15*b* and a transition portion 15*c*; a door 40 comprising a plurality of door panels 41–46 hingedly connected to one another via roller support hinges 10 which have rollers 12 rotatably mounted therein, a door lock assembly 47 on the far side (outside) of the door and a bottom seal 39.

A counterbalance assembly is mounted in an extension of the inverted "L" shaped track. The counterbalance for operator assembly 20 includes a counterbalance shaft 21, a pair of cables 22, a pair of cable drums 25 and a torsion spring 23. In a conventional assembly, the cable 22 is connected proximate the lower edge of the bottom door panel 41 as indicated in FIG. 1. The assembly of the counterbalance component is conventional and well known especially with respect to overhead or roll-up doors used in highway trailers.

Figure 3:
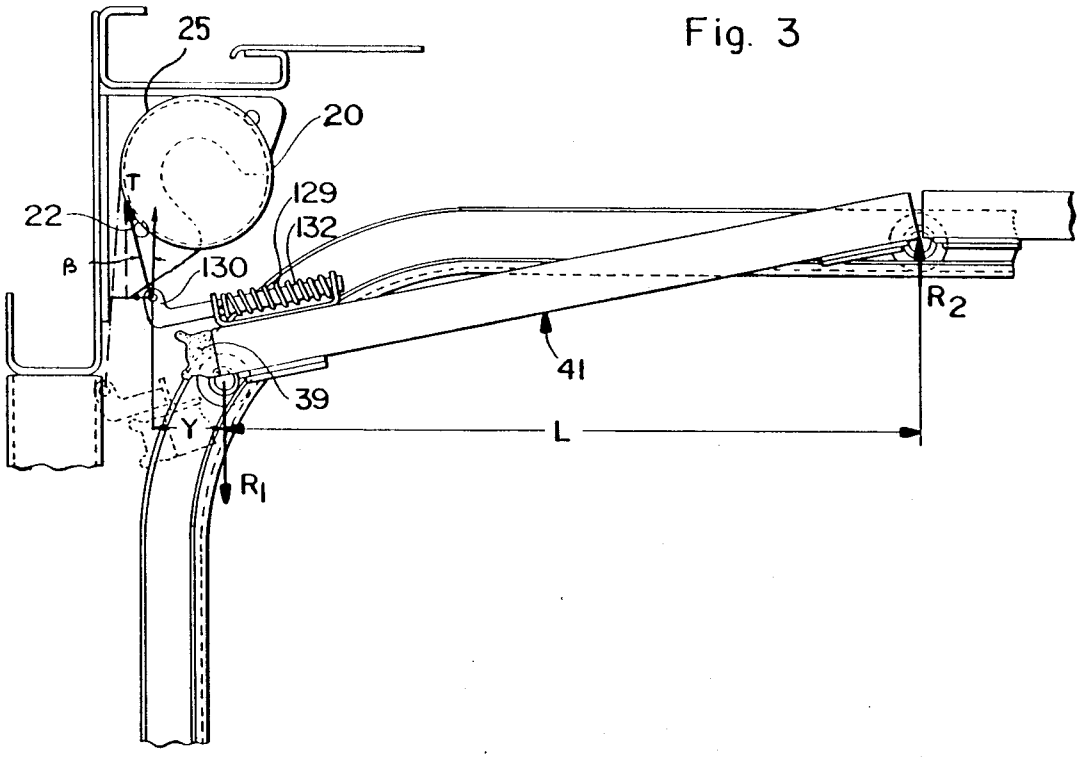
FIG. 3 is a side view of a first illustrative example of the present invention in which the cable is connected to the bottom door panel via a spring loaded cable anchor, functionally identical to the commercial design shown in FIG. 5.
Figures 4, 5, 5A, 5B, 6A, 6B:
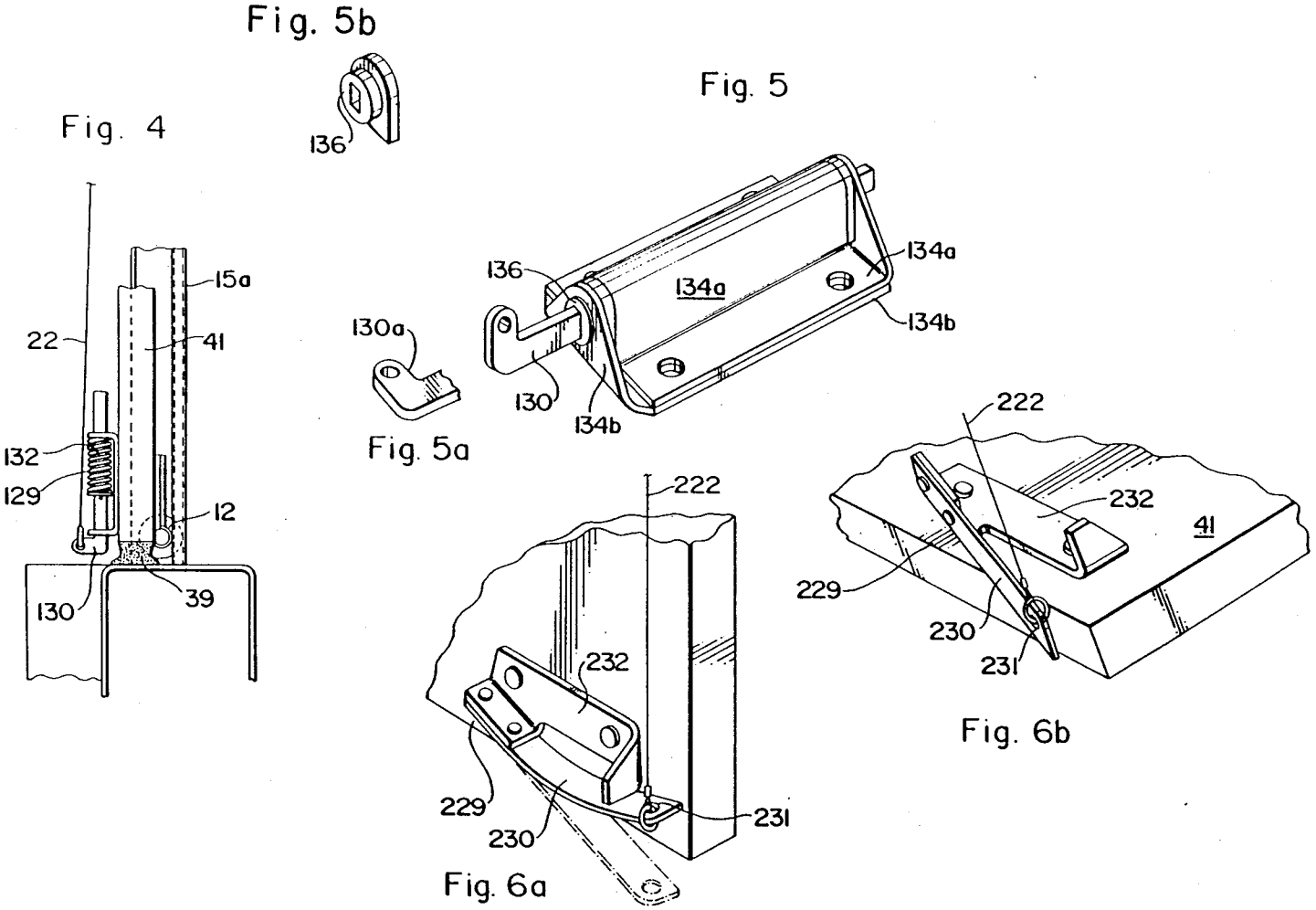
FIG. 4 is a side view of the example of FIG. 3 with the door in the closed position.
FIG. 5 is a perspective view of a commercial design concept of the illustrative example of FIGS. 3 and 4.

FIGS. 3 and 4 illustrate an example of a first method of maintaining the door in the raised position. Specifically, this method contemplates maintaining the door in the raised position by increasing the lever arm through which the cable pull force acts on the bottom door panel. As shown in FIG. 3, in connection with this first illustrative example, the cable 22 of the operator 20 is connected to the bottom door panel 41 via a spring loaded cable anchor 129. It should be noted that the configuration of the spring loaded cable anchor 129 shown in FIGS. 3 and 4 is somewhat schematic. The actual design, an example of which is shown in perspective in FIG. 5 and described below, preferably includes a housing to enclose the spring and a bushing formed of a self lubricating polymer such as TEFLON to reduce the sliding friction of the plunger. FIG. 5 shows an illustrative example of such a device.

As best shown in FIG. 3, in the door open position, the plunger 130 to which the cable 22 is attached is biased by the spring 132 past the bottom edge of the bottom door panel 41 and past the seal 39. By virtue of this displacement of the plunger 130, the effective point of attachment of the cable 22 to the door 41 is moved well past the bottom edge of the seal 39. Consequently, the door assumes a raised position higher than that assumed by a door having a conventional cable anchor. For instance, in the illustrated example which would apply to the conventional highway trailer overhead or roll-up door, a 6 $\frac{7}{8}$" header extends vertically downward further than the lowermost edge of the seal 39. In contrast as indicated in FIG. 1, with a conventional cable anchor, a 8$\frac{1}{8}$" header is needed to adequately shield the lower edge of the seal 39.

As best shown in FIG. 4, in the door closed position, the plunger 130 of the spring loaded cable anchor 129 is retracted against the bias of the spring 132 so that the plunger 130 does not interfere with the proper closing of the door. Thus, the spring loaded cable anchor achieves the desired result without adversely affecting operation of the door or operator.

As mentioned above, the addition of the spring loaded cable anchor causes the door to be raised to a comparatively high position in the door opened position. This is primarily the result of the displacement of the point of attachment of the cable 22 to the door 40 via the plunger 130 of the spring loaded cable anchor 129. Specifically, by displacing the attachment point beyond the outer edge of the seal 39, the orientation of the tension vector T is changed to a more vertical orientation, i.e., the angle $\beta$ between the tension vector and its vertical component is smaller than the angle $\alpha$ between the tension vector and its vertical component in the conventional assembly illustrated in FIG. 1.

As a result of the reorientation of the torsion vector, the vertical component of that vector (T cos $\beta$) is greater than the vertical component in a conventional system. The greater vertical component of the torsion vector in the modified system results in a greater reaction R1 at the bottom roller and consequently a greater lifting force in opposition to the reaction force. More specifically, the change in the direction of the cable tension vector (reduction of angle $\alpha$ in FIG. 1 to angle $\beta$ in FIG. 3) increases the desirable vertical force component (T cos $\alpha$ to T cos $\beta$) and reduces the undesirable or detrimental horizontal force component (T sin $\alpha$ to T sin $\beta$). The relocation of the application of the tension force T also increases the horizontal distance between the point of attachment and the point of reaction on the bottom roller 12. Specifically, as illustrated in FIGS. 1 and 4, the small dimension "X" becomes the large dimension "Y". This increases the leverage around the fulcrum at reaction force R2. As a result of the aforementioned changes, $\mathbf{R1}_{(FIG.\ 1)}$ is equal to T cos $\alpha$+T cos $\alpha$x"X"/"L" while $\mathbf{R1}_{(FIG.\ 3)}$ is equal to T cos $\beta$+T cos $\beta$x"Y"/"L". Since is smaller than $\alpha$, these equations indicate that the modification shown in FIG. 3 yields a substantial increase in the magnitude of R1. It should be noted, however, that the actual increase in reaction force is somewhat less than indicated by these equations since the change in dimension L due to the change of the slope of the bottom panel very slightly reduces the increase of R1. However, since this reduction is negligible it has been ignored to simplify the aforementioned analysis.

In addition to increasing the reaction force R1 which directly increases the bottom panel lifting moment, the spring loaded cable anchor reduces the horizontal force component, T sin $\alpha$ to T sin $\beta$ which is advantageous, since this component tends to pull the door the wrong way (down rather than up).

It should be understood that the aforementioned advantages (i.e., increasing of the lifting force and reduction of the detrimental horizontal force) are the result of the relocation of the attachment point. Accordingly, similar advantageous results can be achieved by any structure which causes such a relocation of the attachment point. The major design constraint is, of course, that the structure for relocating the attachment point must not interfere with door closing in the door closed position.

FIG. 5 shows a perspective view of a spring loaded cable anchor which is suitable for commercial use. In this embodiment, a housing 134 comprising two pieces 134*a* and 134*b* is provided to enclose the spring 132 (not shown) and to retain antifriction bushings 136 which are preferably constructed of a self lubricating polymer such as TEFLON or the like. The antifriction bushings 136 slidably support the plunger 130 which is preferably constructed of stainless or well plated steel. FIG. 5 also indicates a possible optional plunger orientation 130*a* which could be used if it were desirable to place the cable anchor closer to the door panel surface so as to, for example, allow the tips of the plunger 130 to bypass the cable drum 25 thereby eliminating the need for door stops to prevent damage.

As noted above, the advantages of the present invention are achieved through any design which allows the cable attachment point be relocated in the open door position. Accordingly, numerous designs for achieving the advantages of the present invention are possible. FIG. 6 illustrates one such alternative design as a second illustrative example of the present invention.

In the example shown in FIG. 6, the cable anchor 229 comprises a flat spring 230 mounted to door via a mounting bracket 232 at one end and having a cable attachment hole 231 at a second end. The flat spring 230 is mounted such that in the door open position shown in FIG. 6*b*, the cable attachment opening 231 is located well beyond the lower edge of the bottom door panel 41 and the seal 39 (not shown). However, in the door closed position shown in FIG. 6*a*, the spring 230 deflects from the position shown in phantom to the position shown in solid lines to avoid interference with the door closed position.

The design shown in FIG. 6 offers numerous advantages in terms of simplicity, reliability and cost. However, it is essential that the right combination of required flexibility in the bending direction and stiffness in the planar direction be maintained. The reliability of this design is a consequence of the fact that the device is essentially frictionless so that there is virtually no wear except at the cable attachment point and no loss in the force vector which lifts the edge of the door panel in the open position.

A third illustrative example of the present invention is shown in FIG. 7. In this example, the cable anchor 329 is similar to that shown in FIG. 6. However, instead of a flat spring, a mouse trap type torsion spring 336 pivotally biases a flat pivoting arm 330 away from mounting bracket 332. The arm 330 pivots about a pivot pin 334 around which the mouse trap type torsion spring 336 is wound. The flat pivoting arm 330 has a cable attachment hole 331 at its distal end.

The three aforementioned examples of the present invention illustrate a fully automatic method of maintaining the door in the high open position in accordance with the present invention, namely, attaching the cable to the bottom door panel at a point below the lower edge of the door panel through a special cable anchor fitting with a floating cable attachment point. The movement of this attachment point from its "extended" to its "retracted" position and back is achieved by utilizing the combination of the variable cable tension and the positional change of the door itself (from vertical to horizontal and vice versa), two features already existing on every overhead door; thus the completely automatic action of this cable anchor is obtained in the simplest possible way at minimum cost.

Of course, other methods to keep the bottom door panel from sagging, when door is in the open position, can and have been used.

The simplest of these is a hole through the track with a removable pin, to block the door from rolling back, after it has been pushed high enough to clear the hole. Such an arrangement is illustrated in FIG. 8. The door must be pushed and the pin 430 inserted and removed manually, which, with the combination of high door opening and a short or medium height person, requires climbing on a stepstool, ladder, etc.

A more sophisticated arrangement is illustrated in FIG. 9. In accordance with this arrangement, a spring loaded detent 629 permits passing of the door rollers during the opening phase, but blocks the lowest roller from moving back, and thus holds the door in the desired "high" position; the release is effected by pulling the cable or string 632, which withdraws the detent from the track against the bias of spring 630. Assuming, that the door, when given a hard upward push at the end of the operator's reach, will continue to roll up some distance by sheer momentum (at least past the position of the detent), such mechanism would, indeed, eliminate the need for the stepstool or ladder.

However, the arrangement illustrated in FIG. 9 and similar designs based on the same idea have two serious drawbacks. First, on their way up, not only the bottom roller, but all the rollers will depress the detent and let it snap back; considering the number of rollers on each door and the number of door openings, in, for instance, one year (very high, since the overhead door is the preferred type for short haul, city delivery vehicles). The detent would be actuated hundred of thousands of times. This high number of operating cycles would result in fast wear, unless, of course, more sophisticated components and materials (anti-friction bearings, wear resistant alloys, etc.) would be used at a cost not acceptable for this type of equipment and hardware. To some extent, the wear could be minimized by instructing the door operator to hold tension on the release cable, while opening the door, and to release it only after the final push. However, as a practical matter, such instructions simply would not be followed.

Second, When closing the door, the operator would either have to pull the release cable and hold it, while the door was coming down, or to pull the release once for each roller; either way, this would be an awkward and clumsy operation, requiring one hand just to hold or to jerk the release cable. Moreover, if detents are used in each track and the release cables coming from both tracks are not somehow joined together by a system of pulleys, the operator needs two hands to pull them and has none left over to work the door.

The fully automatic action of the mechanisms in accordance with the present invention eliminates all these problems and gives the trucker the very desirable door opening height increase at a minimal increase in the cost of the overhead door installation.

What is claimed is:

1. In an overhead door assembly comprising a door for closing a door opening, said door comprising a plurality of door panels and a plurality of hinges, each said door panel hingedly connected to at least one adjacent door panel by said hinges so as to form a generally rectangular door having parallel side edges, a lowermost edge and an uppermost edge;

a plurality of rollers rotatably connected to one of said door panels and said hinges, said rollers extending over the side edges of the door;

a pair of guide tracks, said guide tracks guiding said rollers for movement therein, said door being supported by said guide tracks through said rollers for movement between an open and a closed position such that in said closed position a bottom one of said plurality of door panels substantially contacts the lower edge of said door opening;

a load balancing operator fixedly mounted proximate at least one of said plurality of guide tracks, said load balancing operator including a cable having a first distal end connected to said operator and a second distal end connected to said bottom door panel;

the improvement comprising a cable anchor having a first portion secured to the door and a second portion moveable with respect to the door, the second distal end of the cable being connected to the second portion of the cable anchor such that the second distal end of the cable is moveably connected to the door such that when the door is in said open position the cable is attached to said cable anchor at a point beyond the lowermost edge of said door.

2. The overhead door assembly of claim 1 in which the cable is attached to said cable anchor means at a point above the lowermost edge of the door when the door is in the closed position.

3. The overhead door assembly of claim 1 wherein said cable anchor means comprises a spring loaded cable anchor said spring loaded cable anchor comprising a plunger having a cable attachment portion, a mounting bracket mounted to the bottom door panel and a spring, said spring biasing said attachment portion of the said plunger past the lowermost edge of the door such that in the open position the attachment portion extends beyond the lowermost edge of the door and in the door closed position, said cable attachment portion of said plunger being retracted against the bias of said spring to a point above the lowermost edge of said door.

4. The overhead door assembly of claim 3 wherein said plunger is slidably supported in said mounting bracket by a pair of bushings, said bushings being constructed of a self lubricating polymer.

5. The overhead door assembly of claim 1 wherein said cable anchor means comprises a flat spring having first and second longitudinal ends, said first longitudinal end being rigidly secured to said door, said second longitudinal end having a cable attachment portion, said second end being moveable between a position beyond the lowermost edge of the door and a position above the lowermost edge of the door.

6. The overhead door assembly of claim 1 wherein said cable anchor means comprises a pivoting anchor means, said pivoting anchor means comprising a mounting bracket secured to the bottom panel of said door; a pivoting arm having first and second ends, said first end being pivotally mounted on said mounting bracket and said second end including a cable attachment portion; a spring for biasing the pivoting arm away from the lowermost edge of said bottom door panel such that cable attachment portion of said pivoting arm is located below the lowermost edge of the door, said pivoting arm being pivotable against the bias of said spring to a position wherein said cable attachment portion is located above the lowermost edge of the door.

7. The overhead door assembly of claim 1 wherein the cable anchor means comprises a pivoting arm having first and second ends, said first end being pivotably mounted on said door, said second end comprising a cable attachment portion; a spring for biasing the pivoting arm to a first position in which the cable attachment portion of the pivoting arm is located beyond the lowermost edge of the door, said pivoting arm being movable, against the bias of said spring to a second position in which said cable attachment portion is located above the lowermost edge of the door.

8. In an overhead door assembly comprising a door for closing a door opening, the door including a plurality of door panels and a plurality of hinges, each of the door panels being hingedly connected to at least one adjacent door panel by the hinges so as to form a generally rectangular door having parallel side edges, a lowermost edge and an uppermost edge;

a plurality of rollers rotatably connected to one of the door panels and said hinges, the rollers extending over the side edges of the door;

a pair of guide tracks, the guide tracks guiding the rollers for movement along a path within the tracks, the door being supported by the guide tracks through the rollers for movement between an open and a closed position such that in the closed position the lowermost edge of the door substantially contacts the lower edge of the door opening;

at least one load balancing operator fixedly mounted proximate at least one of the plurality of guide tracks, the load balancing operator including a cable for connecting the operator to a bottom one of the plurality of door panels, the cable having a first distal end connected to the operator and a second distal end connected to the door;

the improvement wherein the second distal end of the cable is moveably connected to the door by way of a cable anchor, the cable anchor having a portion which is moveable with respect to the door the second distal end of the cable being attached to the moveable portion of the cable anchor between a position in which a portion of the cable anchor is below the lowermost edge of the door and a position in which the cable anchor is about the lowermost edge of the door such that when the door is in the open position the cable is attached to the cable anchor at a point beyond the lower most edge of the door.

9. The overhead door assembly of claim 8 in which the cable is attached to the cable anchor at a point above the lowermost edge of the door when the door is in the closed position.

10. The overhead door assembly of claim 8 further comprising a biasing device for biasing the moveable portion of the cable anchor to a position in which the point of attachment of the second distal end of the cable to the moveable portion of the cable anchor is below the lowermost edge of the door when the door is in the open position.

11. In an overhead door assembly comprising a door for closing a generally rectangular door opening, the door opening comprising parallel side edges, an upper edge and a lower edge, the door comprising:

a plurality of door panels and a plurality of hinges, each of the door panels being hingedly connected to at least one adjacent door panel by the hinges so as to form a generally rectangular door having parallel side edges, a lowermost edge and an uppermost edge;

a plurality of rollers mounted on the door, each of the rollers including a rotatably peripheral portion, the peripheral portions of the rollers extending over the side edges of the door;

a pair of door guide tracks, each door guide track supporting a plurality of the rollers so as to support the door via the rollers for movement between an open and a closed position, the lowermost edge of the door contacting the lower edge of the door opening when the door is in the closed position such that the door opening is substantially closed when the door is in the closed position;

at least one lowermost roller connected to the bottom door panel proximate the lowermost edge of the door, the lowermost roller being rollable within one of the guide tracks along a path defined by the guide track between the open and the closed positions;

at least one wedge shaped detent and a spring biasing the detent into the path of the lowermost roller such that when the door is in the closed position, the detent extends into the path of the rollers, the wedge shaped detent comprising a wedge face adapted to contact the lowermost roller when the bottom roller is moving in a first direction in the track and a blocking face adapted to contact the lowermost roller when the lowermost roller is moving in a second direction in the track;

the wedge face inclined at an acute angle with respect to the path defined by the guide tracks in the direction of movement of the lowermost roller which contacts it so that when the lowermost roller contacts the wedge face, a force is applied against the bias of the spring causing the detent to yield to the lowermost roller such that the detent is moved against the bias of the spring out of the path of the lowermost roller, the blocking face being biased into the tracks so as to releasibly block movement of the lowermost roller when the roller contacts the blocking face.

12. The overhead door assembly of claim 11 wherein the blocking face is substantially perpendicular to the path defined by the guide tracks.

13. In an overhead door assembly comprising a door for closing a door opening, the door including a plurality of door panels and a plurality of hinges, each of the door panels being hingedly connected to at least one adjacent door panel by the hinges so as to form a generally rectangular door having parallel side edges, a lowermost edge and an uppermost edge;

a plurality of rollers rotatably connected to one of the door panels and the hinges, the rollers extending over the side edges of the door;

a pair of guide tracks, the guide tracks guiding the rollers for movement therein, the door being supported by the guide tracks through the rollers for movement between an open and a closed position such that in the closed position a bottom one of the plurality of door panels substantially contacts the lower edge of the door opening;

at least one load balancing operator fixedly mounted proximate at least one of the plurality of guide tracks, the load balancing operator including a cable for connecting the operator to the bottom door panel, the cable having a first end connected to the operator and a second end connected to the door;

the improvement wherein the second end of the cable is connected to the door by way of a spring loaded cable anchor, the spring loaded cable anchor comprising a plunger having a cable attachment portion, a mounting bracket mounted to the bottom door panel and a spring, the spring biasing the attachment portion of the plunger past the lowermost edge of the door such that in the open position the attachment portion extends beyond the lowermost edge of the door and in the door closed position, the cable attachment portion of the plunger is retracted against the bias of the spring to a point above the lowermost edge of the door.

14. The overhead door assembly of claim 11 wherein the plunger is slidably supported in the mounting bracket by a pair of bushings, the bushings being constructed of a self lubricating polymer.

15. In an overhead door assembly comprising a door for closing a door opening, the door including a plurality of door panels and a plurality of hinges, each of the door panels being hingedly connected to at least one adjacent door panel by the hinges so as to form a generally rectangular door having parallel side edges, a lowermost edge and an uppermost edge;

a plurality of rollers rotatably connected to one of the door panels and the hinges, the rollers extending over the side edges of the door;

a pair of guide tracks, the guide tracks guiding the rollers for movement therein, the door being supported by the guide tracks through the rollers for movement between an open and a closed position such that, in the closed position, a bottom one of the plurality of door panels substantially contacts the lower edge of the door opening;

at least one load balancing operator mounted proximate at least one of the plurality of guide tracks, the load balancing operator including a cable for connecting the operator to the bottom door panel, the cable having a first end connected to the operator and a second end connected to the door;

the improvement wherein the second end of the cable is connected to the door by way of a moveable cable anchor, the cable anchor comprising a flat spring having first and second longitudinal ends, the first longitudinal end being rigidly secured to the door, the second longitudinal end having a cable attachment portion, the second longitudinal end being moveable between a position beyond the lowermost edge of the door and a position above the lowermost edge of the door, such that, when the door is in the open position, the cable is attached to the cable anchor at a point beyond the lowermost edge of the door.

16. In an overhead door assembly comprising a door for closing a door opening, the door including a plurality of door panels and a plurality of hinges, each of the door panels being hingedly connected to at least one adjacent door panel by the hinges so as to form a generally rectangular door having parallel side edges, a lowermost edge and an uppermost edge;

a plurality of rollers rotatably connected to one of the door panels and the hinges, the rollers extending over the side edges of the door;

a pair of guide tracks, the guide tracks guiding the rollers for movement therein, the door being supported by the guide tracks through the rollers for movement between an open and a closed position such that in the closed position a bottom one of the plurality of door panels substantially contacts the lower edge of the door opening;

at least one load balancing operator mounted proximate at least one of the plurality of guide tracks, the load balancing operator including a cable for connecting the operator to the bottom door panel, the cable having a first end connected to the operator and a second end connected to the door;

the improvement wherein the second end of the cable is connected to the door by way of a moveable cable anchor, the cable anchor comprising a pivoting anchor, the pivoting anchor comprising a mounting bracket secured to the bottom panel of the door; a pivoting arm having first and second ends, the first end being pivotably mounted on the mounting bracket and the second end including a cable attachment portion; a spring for biasing the pivoting arm away from the lowermost edge of the bottom door panel such that cable attachment portion of the pivoting arm is located below the lowermost edge of the door, the pivoting arm being pivotable against the bias of the spring to a position wherein the cable attachment portion is located above the lowermost edge of the door.

17. In an overhead door assembly comprising a door for closing a door opening, the door comprising a plurality of door panels and a plurality of hinges, each door panel being hingedly connected to at least one adjacent door panel by the hinges so as to form a generally rectangular door having parallel side edges, a lowermost edge and an uppermost edge;

a plurality of rollers rotatably connected to one of the door panels and the hinges, the rollers extending over the side edges of the door;

a pair of guide tracks, the guide tracks guiding the rollers for movement therein, the door being supported by the guide tracks through the rollers for movement between an open and a closed position such that in the closed position a bottom one of the plurality of door panels substantially contacts the lower edge of the door opening;

a load balancing operator mounted proximate at least one of the plurality of guide tracks, the load balancing operator including a cable having a first distal end connected to the operator and a second distal end connected to said bottom door panel;

the improvement comprising a cable anchor, the cable anchor comprising a pivoting arm having first and second ends, the first end being pivotably mounted on the door, the second end comprising a cable attachment portion, the second distal end of the cable being connected to the bottom door panel through the cable attachment portion; a spring for biasing the pivoting arm to a first position in which the cable attachment portion of the pivoting arm is located beyond the lowermost edge of the door, the pivoting arm being moveable, against the bias of the spring, to a second position in which the cable attachment portion is located above the lowermost edge of the door.

18. In an overhead door assembly comprising a door for closing a door opening, the door having parallel side edges, a lowermost edge and an uppermost edge; the door opening having parallel side edges, a lowermost edge and an uppermost edge;

a pair of guide tracks, each guide track defining a path having a portion extending parallel to the side edges of the door opening;

a plurality of rollers rotatably connected to the door, each roller being guided for movement in one of the guide tracks such that the door is mounted by way of the rollers for movement along the path defined by the guide tracks between a closed position in which the lowermost edge of the door contacts the lowermost edge of the door opening and an open position in which the lowermost edge of the door is proximate the uppermost edge of the door opening;

a load balancing operator mounted proximate at least one of the guide tracks;

a moveable cable anchor connected to the door;

a cable, the cable having a first distal end connected to the operator and a second distal end connected to the cable anchor at a connection point such that when the door is in the open position, the connection point is below the lowermost edge of the door and when the door is in the closed position, the connection point moves relative to the door to a location above the lowermost edge of the door.

* * * * *

UNITED STATES PATENT AND TRADEMARK OFFICE

CERTIFICATE OF CORRECTION

PATENT NO. : 4,871,007

DATED : 3 OCTOBER 1989

INVENTOR(S) : Andrew ABOLINS

It is certified that error appears in the above-identified patent and that said Letters Patent is hereby corrected as shown below:

| Column | Line | Corrections |
|---|---|---|
| 1 | 65 | Change "o" to --or--. |
| 2 | 25 | Change "Cable" to --cable--. |
| 3 | 67 | Change "inVention" to --invention--. |
| 4 | 28 | Change "n" to --in--. |
| 6 | 21 | Change "$\delta$be" to --$\alpha$ be--. |
| 6 | 44 | Change "$\alpha$x" to --$\alpha$ x--. |
| 6 | 45 | Change "$\beta$x" to --$\beta$ x--; after "Since" insert --$\beta$--. |
| 8 | 46 | Change "When" to --when--. |

Signed and Sealed this

Twenty-eighth Day of August, 1990

*Attest:*

HARRY F. MANBECK, JR.

*Attesting Officer*

*Commissioner of Patents and Trademarks*